United States Patent [19]

Biricz

[11] 4,022,268

[45] May 10, 1977

[54] CONTINUOUS CASTING PLANT

[75] Inventor: Stefan Biricz, Linz, Austria

[73] Assignee: Vereinigte Osterreichische Eisen- und Stahlwerke-Alpine Montan Aktiengesellschaft, Linz, Austria

[22] Filed: July 21, 1975

[21] Appl. No.: 597,666

[30] Foreign Application Priority Data

July 25, 1974 Austria ..... 6113/74

[52] U.S. Cl. ..... 164/282; 292/130

[51] Int. Cl.[2] ..... B22D 11/12

[58] Field of Search ..... 164/282, 98–136; 292/130–136, 95–103

[56] References Cited

UNITED STATES PATENTS 2,200,056 5/1940 Buttermann ..... 292/98

3,794,107 2/1974 Bollig et al. ..... 164/282

FOREIGN PATENTS OR APPLICATIONS 20,855 1/1946 Finland ..... 292/101

*Primary Examiner*—Robert D. Baldwin

*Attorney, Agent, or Firm*—Brumbaugh, Graves, Donohue & Raymond

[57] ABSTRACT

A continuous casting plant has a guiding means for the strand. This guiding means, at its upper end, is provided with bolts which can be suspended in hooks on the supporting steel structure. The bolts are secured against being lifted out of the hooks by means of one or more latches which in their closed position engage with the bolts and are pivotably arranged on the supporting steel structure.

7 Claims, 3 Drawing Figures

CONTINUOUS CASTING PLANT

BACKGROUND OF THE INVENTION

The invention relates to a continuous casting plant with a guiding means for the strand comprising supporting and guiding rollers, which guiding means is suspendible in a supporting steel structure.

In known constructions the strand guiding section following the mould, which section can contain a straight guiding path or a guiding path following a transition curve, is either rigidly connected to the supporting steel structure or is suspended in hooks of the structure and fixed by means of screws. The rigid connection has the disadvantage that it is statically undefined and that during disturbances leading to an interruption of the casting, uncontrollable forces and moments are introduced into the supporting steel structure. This is especially the case when the drivers vigorously move a strand stuck in the strand guide to and fro. The suspension with hooks and an additional screw connection at the steel structure have also proved to be unsatisfactory for the same reasons, i.e. because of undefined forces and tensile moments that occur during the to-and-fro movement of a strand piece that is to be extracted. The forces that occur can be statically determined; however, the strand guiding means is not reliably secured against being lifted out of the hooks.

SUMMARY OF THE INVENTION

The invention aims at preventing the above described disadvantages and difficulties and has as its object to create a suspension device for strand guiding sections which is statically defined and reliably secured against being lifted out of the supporting steel structure.

According to the invention this object is achieved in that the upper end of the strand guiding means or a section of the strand guiding means is provided with bolts which can be suspended in hooks of the supporting steel structure. The bolts are secured against lifting out by means of one or more latches which in their closed position engage with the bolts and are pivotably arranged on the supporting steel structure.

Preferably the pivot bearings of the latches are outwardly offset from the vertical plane of the bolts, i.e. towards the supporting structure.

It is suitable that the contacting face of the latch relative to the bolt is plane or has a flatter curvature than that of the bolt, so that the normal to the tangent extends on the support structure side of the latch pivot bearing and the angle between the normal to the tangent and the vertical is smaller than the angle of friction.

Suitably, the foot part of the latch is weight-loaded, so that a closing moment is created.

Advantageously, the other end of the strand guiding means or a section of the strand guiding means is mounted on the steel structure by means of pendulum brackets.

The suspension according to the invention with bolts and latches constitutes an ideal fixed bearing. When the lower bearing contains pendulum brackets, the forces that occur are statically completely defined.

BRIEF DESCRIPTION OF THE DRAWINGS

In order that the invention may be more fully understood, an embodiment thereof will now be described by way of example and with reference to the accompanying drawings wherein.

DESCRIPTION OF AN EXEMPLARY EMBODIMENT

Figure 1:
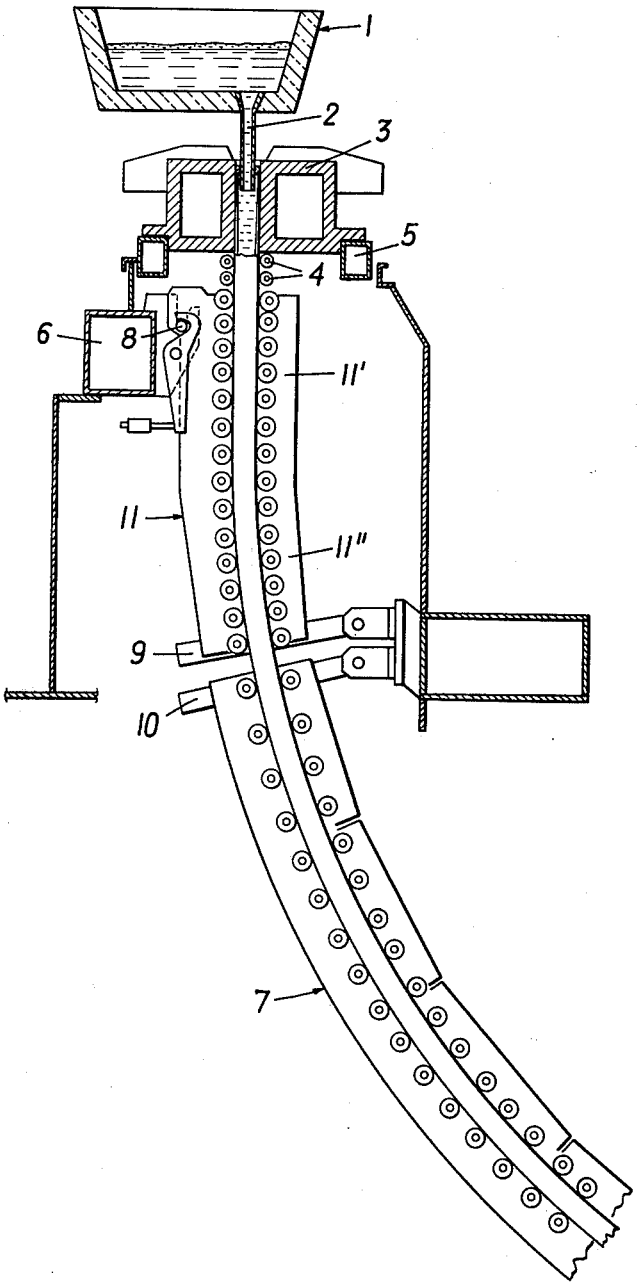
FIG. 1 is a full view of the plant of the invention.

In FIG. 1 the tundish is denoted with 1 and is provided with a casting tube 2 through which the molten steel flows into the mould 3. The mould with its foot rollers 4 rests on a lifting table 5 which is put into a reciprocating motion by a drive. Below the foot rollers of the mould, the strand guiding means having supporting and guiding rollers is mounted on the structure 6. The strand guiding means in the example shown here is constructed in two sections and consists of an upper strand guiding section 11 and a lower strand guiding section 7. The upper end of the strand guiding section 11 is arranged in a fixed bearing which is generally denoted with 8, and the lower end is arranged in a pendulum bracket bearing 9. The strand guiding section 11 is formed as a bending zone, i.e. it consists of a vertical portion 11' and a lower portion 11'' following a transition curve. The strand guiding section 7 has the shape of a circular arc. Its upper end is also arranged in pendulum brackets 10 and its lower end (not shown) is arranged in a fixed bearing.

Figure 2:
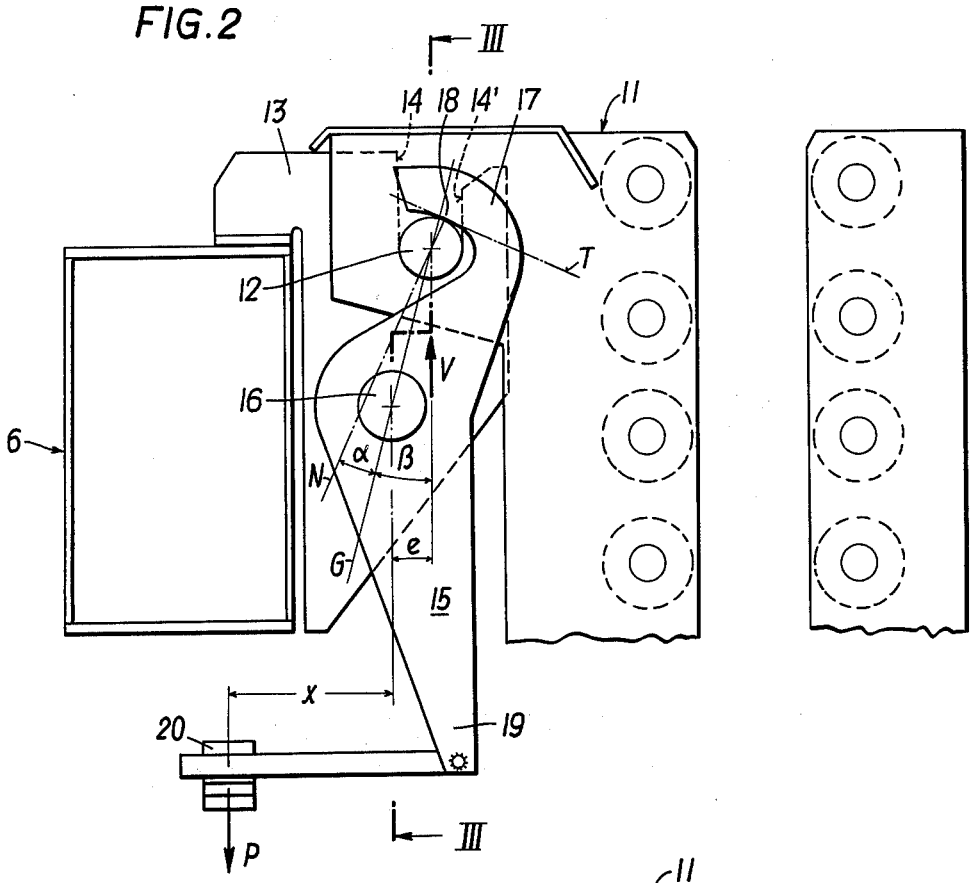
FIG. 2 is a side view of the suspension in the fixed bearing according to the invention.
Figure 3:
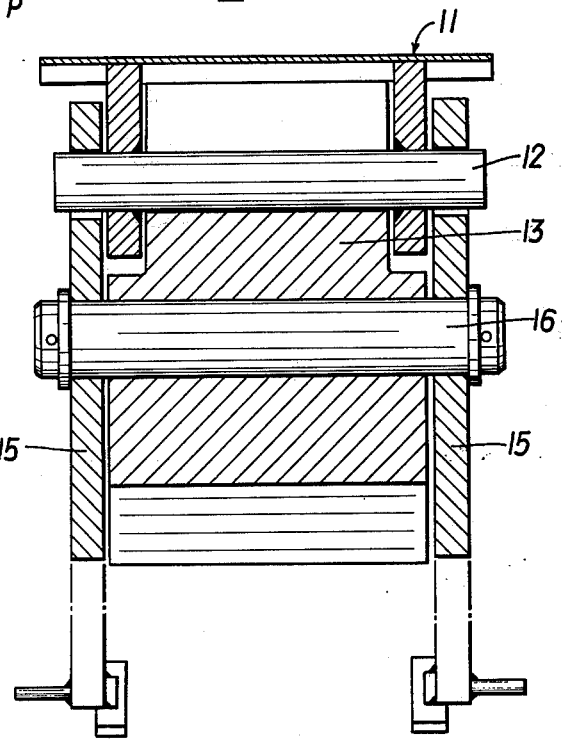
FIG. 3 is a section along line III—III of FIG. 2.

In FIG. 2 and FIG. 3 it can be seen that the strand guiding section 11 following the mould and formed as the bending zone comprises bolts 12, which bolts can be suspended in hooks 13 secured to the structure 6. These hooks 13 have vertical side faces 14 and 14', so that the forces acting via the bolts upon a latch 15 are always vertically directed. The bolts are secured against lifting out of the hooks 13 by means of the latches 15 which are pivotably secured to the structure 6. The pivot bearings 16 are outwardly offset, i.e. toward the supporting structure, relative to the vertical plane extending through the bolts 12, to the extent $e$, so that vertical forces which occur act upwardly with a moment equal to $(V \cdot e)$ and press the closing part 17 of the latch in a direction closing it to the left. In this way the latch is self-locking. The contacting face 18 of the latch portion 17 is flat or has a flatter curvature than the curvature of the bolt 12. The tangent normal N and the connection straight line G enclose the angle $\alpha$. The tangent normal N thus takes a somewhat offset course relative to the connection straight line G. Because of the angle $\alpha$ between the normal N to the contacting tangent T and the connection straight line G, between the center of the bolt 12 and the center of the pivot bearing 16, a "tightening" of the latch is achieved so that, due to the closing moment equal to $(P \cdot x)$, a connection that is tight or without play forms between the latch and the bolt.

In the embodiment of the invention the latch is self-locking, if $\alpha$, the angle between N and G, and $\beta$, the angle between the connection straight line G and the vertical, together are smaller than the angle of friction.

The lower part 19 of the latch is loaded with a weight 20, so that the latch automatically adopts the closing position, even when not loaded.

The lower end of the strand guiding section 11 is secured to the structure 6 by means of the pendulum brackets 10. This method of suspension enables expansions of the strand guiding means or movements around the upper fixed bearing without the occurrence of jamming.

What I claim is:

1. A continuous casting plant comprising:

a supporting structure with upwardly open hooks;

a strand guiding means with supporting and guiding rollers, said guiding means being provided with generally horizontal bolts at its upper end, said bolts being suspendible in the hooks of the supporting structure;

at least one latch with a hook-shaped end being pivotably secured to the supporting structure by means of a pivot bearing, said latch engaging said bolts with its hook-shaped end when in a vertical closing position so as to close off the upwardly open hooks; and means for maintaining the latch in said vertical closing position so as to secure the bolts against being lifted out of the hooks, said latch being rotatable out of the vertical position to permit the release of the bolts from the hooks, thereby permitting removal of the strand guide means from the supporting structure by an upward motion of the guide.

2. A continuous casting plant as set forth in claim 1, wherein said latch has a face of contact relative to the bolt that is of lesser curvature than the curvature of the bolt, the tangent normal extending at the supporting structure side of the pivot bearing, and wherein the tangent normal and the vertical enclose an angle that is smaller than the angle of friction.

3. A continuous casting plant as set forth in claim 2, wherein the latch has a flat face of contact relative to the bolt.

4. A continuous casting plant as set forth in claim 1, wherein the means for maintaining the latch in said vertical closing position includes a weight-loaded foot part of said latch, whereby a closing moment is created.

5. A continuous casting plant as set forth in claim 1, wherein the downstream end of the strand guiding means is secured to the supporting structure by means of pendulum brackets.

6. A continuous casting plant as set forth in claim 1, wherein the strand guiding means is composed of at least two sections, the downstream end of the uppermost section being mounted on the supporting structure by means of pendulum brackets.

7. A continuous casting plant comprising:

a supporting structure with upwardly open hooks;

a strand guiding means with supporting and guiding rollers, said guiding means being provided with generally horizontal bolts at its upper end, said bolts being suspendible in the hooks of the supporting structure;

at least one latch with a hook-shaped end being pivotably secured to the supporting structure by means of a pivot bearing, said latch engaging said bolts with its hook-shaped end when in a vertical closing position so as to close off the upwardly open hooks, said pivot bearing being outwardly offset from the vertical plane of said bolts in the direction toward the supporting steel structure when the bolts are secured in the hooks; and means for maintaining the latch in its vertical closing position so as to secure the bolts against being lifted out of the hooks, said latch being rotatable out of the vertical position to permit the release of the bolts from the hooks, thereby permitting removal of the strand guide means from the supporting structure by an upward motion of the guide.

* * * * *